US008865992B2

(12) United States Patent
Shavit

(10) Patent No.: US 8,865,992 B2
(45) Date of Patent: Oct. 21, 2014

(54) SOUND MANIPULATOR

(75) Inventor: Daniel Shavit, Modi'in (IL)

(73) Assignee: Guitouchi Ltd., Modiin (IL)

( * ) Notice: Subject to any disclaimer, the term of this patent is extended or adjusted under 35 U.S.C. 154(b) by 0 days.

(21) Appl. No.: 13/991,913

(22) PCT Filed: Dec. 6, 2011

(86) PCT No.: PCT/IL2011/000927
§ 371 (c)(1),
(2), (4) Date: Jun. 6, 2013

(87) PCT Pub. No.: WO2012/077104
PCT Pub. Date: Jun. 14, 2012

(65) Prior Publication Data

US 2013/0263721 A1 Oct. 10, 2013

(30) Foreign Application Priority Data

Dec. 6, 2010 (GB) ..... 1020585.4

(51) Int. Cl.
*G10H 1/34* (2006.01)

(52) U.S. Cl.
USPC ..... 84/615; 84/653

(58) Field of Classification Search
USPC ..... 84/615, 653
See application file for complete search history.

(56) References Cited

U.S. PATENT DOCUMENTS

| | | | | |
|---|---|---|---|---|
| 2,368,257 | A | 1/1945 | McBride | |
| 4,481,854 | A * | 11/1984 | Dugas | 84/736 |
| 5,105,711 | A * | 4/1992 | Barnard | 84/744 |
| 6,005,181 | A | 12/1999 | Adams et al. | |
| 6,570,078 | B2 | 5/2003 | Ludwig | |
| 7,541,536 | B2 | 6/2009 | Daniel | |
| 8,093,486 | B2 * | 1/2012 | Behringer et al. | 84/615 |
| 8,609,973 | B2 * | 12/2013 | D'Amours | 84/746 |
| 8,710,346 | B2 * | 4/2014 | Behringer et al. | 84/644 |
| 2014/0083279 | A1 * | 3/2014 | Little et al. | 84/609 |
| 2014/0083280 | A1 * | 3/2014 | Little et al. | 84/609 |

OTHER PUBLICATIONS

International Search Report of PCT Application No. PCT/IL2011/000927 dated May 2, 2012.

* cited by examiner

*Primary Examiner* — David S. Warren
(74) *Attorney, Agent, or Firm* — Pearl Cohen Zedek Latzer Baratz LLP

(57) ABSTRACT

A sound manipulator comprising a touch sensitive sensor detecting finger tapings and multiplying them electronically on simultaneously produced sound, such that touches and releases affect sound composition in part (e.g. added sound effects and their characteristics) or as a whole (e.g. full or partial muting). The Sound manipulator may be attached to a guitar and allow the player both pick and tap fretted tones to give a fully new type of sound producing to the guitar. Rhythmical and electronic music may be imitated by the Sound manipulator, without losing the basic authentic guitar sound and while maintaining the flavor of live play.

28 Claims, 12 Drawing Sheets

SOUND MANIPULATOR

CROSS-REFERENCE TO RELATED APPLICATIONS

This application is a National Phase Application of PCT International Application No. PCT/IL2011/000927, International Filing Date Dec. 6, 2011, entitled "SOUND MANIPULATOR", published on Jun. 14, 2012 as International Publication Number WO 2012/077104, claiming priority of GB Patent Application No. 1020585.4, filed Dec. 6, 2010, both of which are incorporated herein by reference in their entirety.

BACKGROUND

1. Technical Field

The present invention relates to the field of music appliances, and more particularly, to instrument interfaces.

2. Discussion of Related Art

The evolution of modern music has been greatly influenced by technological innovations that have offered musicians an ever-increasing palette of sounds and with that, the potential to make new music.

As distortion and other effects led to an explosion in guitar-dominated rock genres, and as the synthesizer gave keyboard players a leading role in pop music, a new technology is about to give guitar players access to new creative horizons.

Many of today's leading popular music genres, such as dance, hip hop, rap, house or techno are dominated by synthesizer and computer-generated melodies, featuring sharp, fast beats and electronic sounds that the electric guitar has difficulty blending in with. In the rock world, where the guitar is still king, new technologies are well received as players seek to expand their creative arsenals.

In this application we propose a new system and method that will provide a new and exciting way to play the electric guitar. It offers guitar players to utilize a new palette of sounds, expanding their creativity, and allowing them to take a more active role in the creation of today's popular music.

U.S. Pat. No. 7,541,536, which is incorporated herein by reference in its entirety, discloses a multi-sound effect system including dynamic controller for an amplified guitar.

U.S. Pat. No. 7,541,536 comprises attaching a signal processing unit along with a touch-sensitive dynamic control unit upon the front panel of the guitar's body for controlling and processing electrical signals produced by an amplified guitar, e.g. electric, bass, acoustic or classical guitar. This arrangement enables the guitar player to dynamically control and manipulate in a convenient way the multi-sound effect parameters. The unit provides the guitar player with control over up to three dimensions of these parameters while simultaneously playing the guitar.

The system is composed of a Signal Processing Unit (SPU), such as a Digital Signal Processor (DSP) and a Dynamic Control Unit (DCU). The DCU is a touch-sensitive dynamic control unit implemented as a sliding potentiometer, a roller potentiometer, push buttons, a tracking-ball, a touch-pad, a touch-screen, a dynamic ribbon, a joystick, a mouse, optical sensor array, infrared sensors or as a combination thereof. The SPU receives audio signals from the guitar pick-ups and control signals from the DCU, whereas the control signals indicate the location and pressure of the guitar player's finger over the DCU.

The DCU is mounted upon the front panel of the guitar in a way that the guitar player can maneuver at least one of his free fingers (middle, ring or pinky) of his picking hand over the DCU surface in a convenient way while picking or strumming the guitar's strings. In all amplified guitars (i.e. electric, bass, acoustic or classic guitar) the DCU is attached beneath the guitar strings at the lower front area of the guitar body, whereas in a bass guitar the DCU may be further attached above the guitar strings at the upper front area of the guitar body. In the case of a bass guitar, wherein the DCU is located above the strings, the bass player can use his thumb to maneuver upon the DCU and the rest of his fingers to strike the strings.

The DCU includes a sensor which measures up to three dimensions for controlling the multi-sound effect parameters simultaneously in real time, whereas in each dimension a plurality of parameters regarding the sound-effects can be changed. The plurality of parameters include common distortion parameters (such as gain, output level, tone, EQ or filter), common compressor parameters (such as Input level, threshold, gain reduction ratio, knee, attack time, release time, output level), common gate parameters (such as threshold, attack time, gain reduction ratio, range, hold or release time, decay time, output level), common modulation effect parameters (such as rate, feedback or regeneration, time delay, depth, mix), common filter effects or wah-wah parameters (such as low-pass, band-pass and high-pass filter frequency) common delay parameters (such as delay time, feedback, mix) and common reverb parameters (such as pre or initial delay, diffusion, crossover point, high and low frequency ratio, high and low frequency damping, density, balance, or early reflection delay).

FIG. 1 is an overview illustration describing the different components comprising the multi-sound effect system according to the prior art. The Input Device 11 is provided for transmitting audio signals to the multi-sound effects system 10, whereas the Output Devices 12 are provided for receiving audio signals, for receiving and transmitting control signals and for sharing data, audio and program files containing information regarding the operation and programming of the multi-sound effects system.

The Input Device 11 is comprised of an electric guitar 13, whereas the DCU 14 is attached to the lower area of the front panel. Attaching the DCU to this area of the guitar allows the guitar player to maneuver at least one of his picking hand fingers over the DCU in a convenient way while playing the guitar. Most electric guitars are completely passive, i.e. consume no power, therefore one doesn't have to plug them into a power supply. The audio signals leave the guitar through the output jack 15, which is located on the guitar body 9, and transmitted into the system through the Interface Unit 16. The signal transmission is applied either by a wire cable or other wireless mechanism allowing the transmitting of the audio signals from the guitar into the system. In some cases an Intermediate Unit 31, comprising of other instrument devices, may be applied between the guitar and the system. The intermediate unit/s can be; for example, other processing unit/s (e.g. floor-sound effects, multi-effect processors, rack-mounted processors, stomp boxes, effect pedals, equalizers, desktop effects and portable effects), a pre-amplifier, controller pedals, volume pedals, mixer, single/multi-track recorder machine, computer, other musical instruments, microphone or any combination thereof.

The Output Devices 12 are composed of three different types of devices. The audio signals are transmitted to these devices via a cord cable or wireless mechanism.

The first type of device 17 is comprised of an electrical instrument that reacts to the transmission of audio signals received from the system. These devices may include a guitar amp, head-phone, other multi-sound effects system, other kinds of audio signals processors (e.g. floor sound effect, multi-effect processors, rack-mounted processors, stomp boxes, effect pedals, equalizer, desktop guitar effect, portable effect), musical instrument, mixer, record machine or combination thereof.

The second type of device 18 is comprised of an electrical instrument used for communicating with the system in order to receive the control signals, transmit the signals, or share data, audio and program files regarding the multi-sound effects. These devices may include a PC, a memory card, an external programming unit and other equivalent multi-sound effect systems.

The third type of device 19 is comprised of an electrical musical instrument used for communicating with different musical instruments, which are supported by a Musical Instrument Digital Interface (MIDI) protocol. The protocol controls and communicates with different musical instruments and sound-effects, providing they support the MIDI protocol.

The Communication Unit 20 connects between the system and Output Devices of the second type 18, thus, providing an efficient communication.

The MIDI Control Unit 21 is provided to connect to the Output Devices of the third type 19 via a cord cable or wireless mechanism. The connection between these devices is to enable control and communicate with different musical instruments and effects that are supported with MIDI protocols.

The Dynamic Control Unit (DCU) 14 is implemented as a touch-sensitive sensor for controlling the SPU algorithm, which process the audio signals produced by the guitar. The DCU is provided for identifying and delivering information concerning the location or pressure of the finger activating the unit. The main advantage of this unit is that it enables the guitar player to dynamically change the various sound-effects and parameters while playing the guitar. The DCU transmits control signals either to the Management Unit 23 or directly to the SPU 22.

The Signal Processing Unit (SPU) 22 is a sound effect or multi-effect audio signal processor. This unit is designated to dynamically process and alter incoming audio signals transmitted from the guitar with respect to the control signals received from the DCU 14, Static Control Unit (SCU) 24 or from the Management Unit 23.

The Static Control Unit (SCU) 24 is comprised of a set of buttons and knobs usually used for accessing, editing, programming and pre-setting sound-effect parameters. While playing the guitar, the SCU enables the guitar player to select and fetch effect programs from the effects bank. The SCU transmits control signals concerning the parameters to the Management Unit 23 or directly to the SPU.

The Management Unit 23 is provided to handle and control the system's operation and functionality. It further manages and controls the system's peripheral devices. The Management unit receives control signals from the SCU and the DCU according to the pre-selected settings and the location of the guitar player's finger over the DCU. The unit includes a processor unit which may be in the form of a micro-processor, a Digital Signal Processing unit (DSP), a designated signal processor (e.g. FPGA, ASIC) or a processing device (e.g. ARM, RISK, Pentium, etc. . . . ). The processor unit translates the control signals into a signal format required by the SPU and processes them according to a set of commands and instructions. In addition, the Management Unit handles memory devices, display drivers, communication protocol between inner units and external devices and manages the different aspects regarding the propose system, such as initialization processes, alarms, boot, timing, programming procedures, effect editing, audio pattern recordings, etc.

The Interface Unit 16 is provided to enable a physical connection between external sources, e.g. input and output devices, and the system for receiving and transmitting audio signals. The Interface Unit at the input stage transmits the analog audio signals received from the Input Device 11 to the Signal Conversion 25 and Amplification 26 Units. Whereas, at the output stage the audio signals are further transmitted to the Output Devices 17

The Signal Conversion Unit 25 includes an Analog to Digital Converter (ADC) unit and a Digital to Analog Converter (DAC). The ADC is provided to convert the analog signals received from the guitar to a digital signals format which required by the SPU. The Digital to Analog Converter (DAC) unit is provided to convert the digital signals to an analog format required by the Output Devices 17.

The Amplification Unit 26 is provided for adjusting the signal's level according to the system's and peripheral devices' requirements.

The Memory Unit 27 is provided for saving and sharing the programs, data and audio files required for the proper operation of the system. The unit includes memory devices which may be in the form of ROM, RAM (such as SDRAM, SRAM.), Nonvolatile memory (such as FLASH, EPROM) or memory cards (such as smart-media, compact flash). The Memory Unit enables to read and write data to and from the SPU 22 and the Management Unit 23.

The Monitor Unit 28 and the Visual Display LEDs 29 are provided to give the guitar player relevant information of the various aspects regarding the system. The various aspects may include the operation status, alarms, operation mode (such as programming or playing modes), multi-effect banks, sound-effect parameters, etc. The Monitor Unit 28 is a complementary unit including a display device, such as an alpha-numeric display, a graphical display, a Seven-Segment display, a touch-screen display, LCD display, TFT display etc.

The Visual Display LEDs unit 29 is a complementary unit comprising light bulbs, such as Light Emitting Diodes and lightened push buttons.

The Keyboard 30 is a complementary unit provided for additional data entering, accessing, selecting and programming multiple sound effects. The communication is applied via an external keyboard or programming device.

FIG. 2 is an illustration of the manner in which the system's inner components and DCU 14 are mounted upon the guitar according to the prior art. The system's inner components (e.g. SCU, SPU) 24 excluding the DCU are mounted upon the front panel of the guitar's body above the guitar's strings. The DCU 31 is mounted upon the front panel of the guitar beneath the guitar's strings. A strap attachment 32 is provided for attaching the components to the body of the guitar, whereas a cord wire 36 is provided for transmitting control signals between these components. The strap attachment passes under the strings of the guitar and elapses over the guitar's body. The guitar's strap buttons 33 may further be included for fastening and stabilizing the manner in which the strap attachment is applied. A cord wire 35 is provided for enabling a data transmission of the audio signals from the guitar to the system's inner components 30 and vice versa. A splitter 34 enables a dual transmission of the audio signals from the guitar to the system and from the system to the Output Devices (e.g. Guitar Amp.) via an additional cord wire 37.

The mechanism is included for attaching and detaching the DCU to the lower front panel of an amplified guitar and to the upper front panel of a bass guitar. The mechanism is at least one strap attachment, which passes under the guitar's strings in between the guitar's pickups. In the case of a lead electric guitar which contains only one pickup (as in Fender Telecaster guitars) the attachment strap passes besides and along the pickup, thus encompassing the body of the guitar and tightening the dynamic control unit to the front panel of the guitar. The attachment means is provided for connecting/disconnecting the DCU along with at least one of the other system's components as a unit to the front panel of the amplified guitar under the guitar's strings An additional method for applying the strap attachment is by threading it from side to side upon the front panel of the guitar and passing it beneath the guitar's strings in the lower area of the guitar body. The attachment encompasses the body of the guitar while tightening the DCU to the front panel of the guitar.

The DCU is attached to the strap attachment using a mechanism from the group of: a pin (similar to the mechanism for combining a strap to a hand watch), a clipping device, a dedicated strap pass or slot in the unit, a velcro strap, a rubber band and a scotch tape.

The mechanism may further be implemented as an attachment means from the group of a clipping device, a velcro strap, glue, vacuum buttons, a rubber band, a scotch tape and bolts.

The multi-sound effect system further comprising a mechanism for attaching the system's components excluding the DCU to the amplified guitar body and to the strap attachment, wherein the mechanism is an attachment means from the group of: a strap, a clipping device, a velcro strap, glue, vacuum buttons and bolts.

In accordance with further improvements of the present invention, it is suggested to provide the player with various options of effect manipulations or combination thereof: Activating, deactivating specific effect type or types; Changing the effect type or types; Activating, deactivating or changing effect patches, which is a combination of several effect types and parameters setting, in which the effect types are combined in a certain order or structure and are played together;

Controlling parameters of effect algorithm which determine the activation pattern of an effect, for example, determining set of time intervals in delay effect according to the time interval between sequential fingers' tapping on a touchpad DCU; bypassing or muting an effect; freezing the values of effect parameters according to last user action or according to predefined settings; Adjusting the effect parameters values in accordance with predetermined continues or discontinues pattern; Adjusting the effect parameters values according to a recorded continues or discontinues path of the finger's motion over the DCU or according to recorded or real time finger's tapping on the DCU.

BRIEF SUMMARY

Embodiments of the present invention provide a sound manipulator comprising: a touch sensitive sensor arranged to detect finger tapping that comprises finger contact upon the touch sensitive sensor ("touch") and finger detachment from the touch sensitive sensor ("release"), and to generate a corresponding time dependant tapping signal comprising a first state corresponding to periods in which the finger contacts the touch sensitive sensor and a second state corresponding to periods in which the finger does not contact the touch sensitive sensor; and a processing unit arranged to: receive an electric audio signal associated with an instrument and control signal associated with the finger tapping upon the touch sensitive sensor; receive at least one state change characteristic; modify the time dependant signal corresponding to the finger tapping according to the at least one state change characteristic; and multiply, with a common time base, the modified time dependant signal with the electric audio signal, to yield a modified electronic signal, wherein changes of the modified electronic signal during changes between the first and the second states of the tapping signal are characterized by the at least one state change characteristic.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
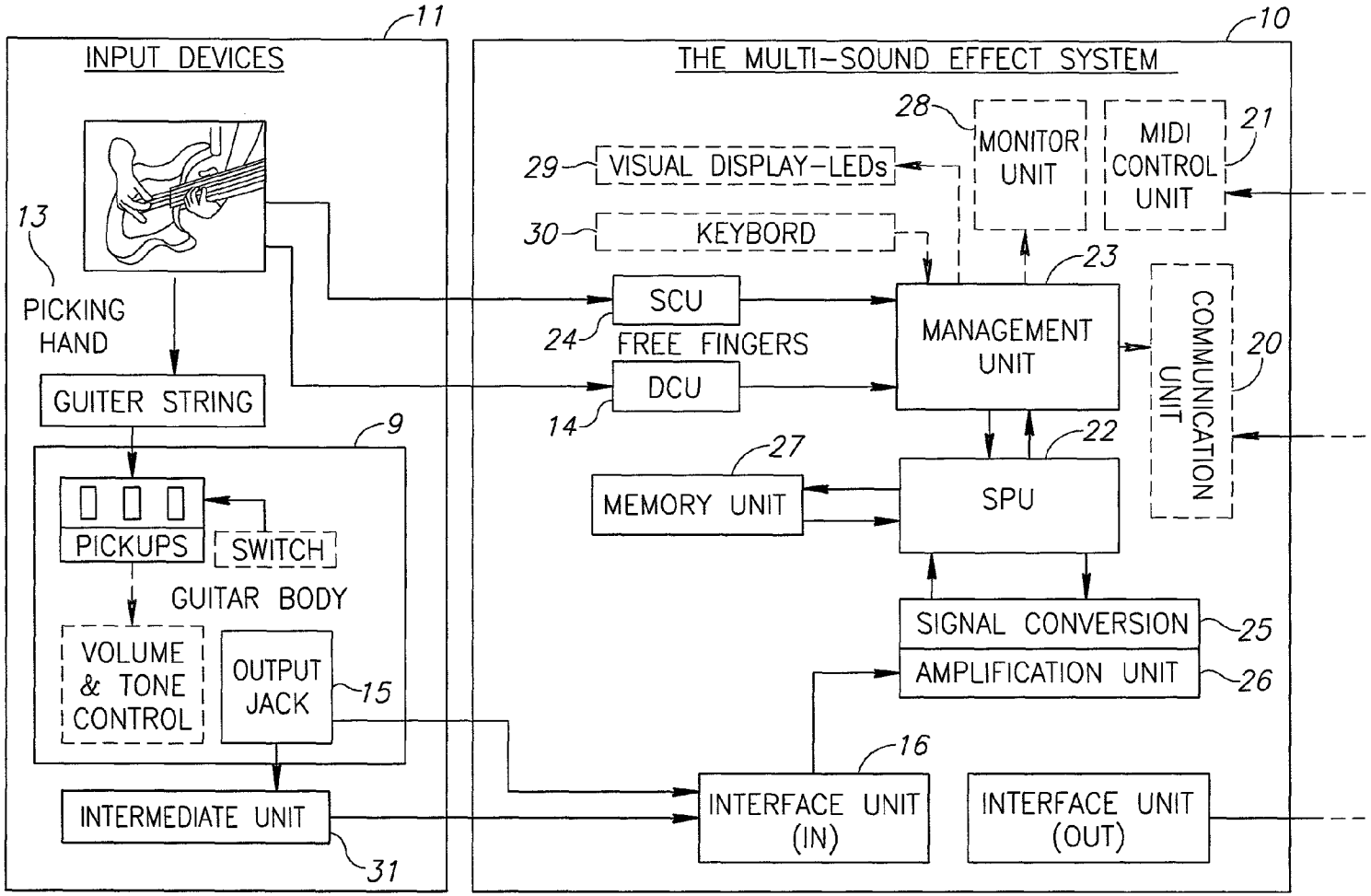
Figure 1 PRIOR ART
FIG. 1 is an overview illustration describing the different components comprising the multi-sound effect system according to the prior art.
Figure 1:
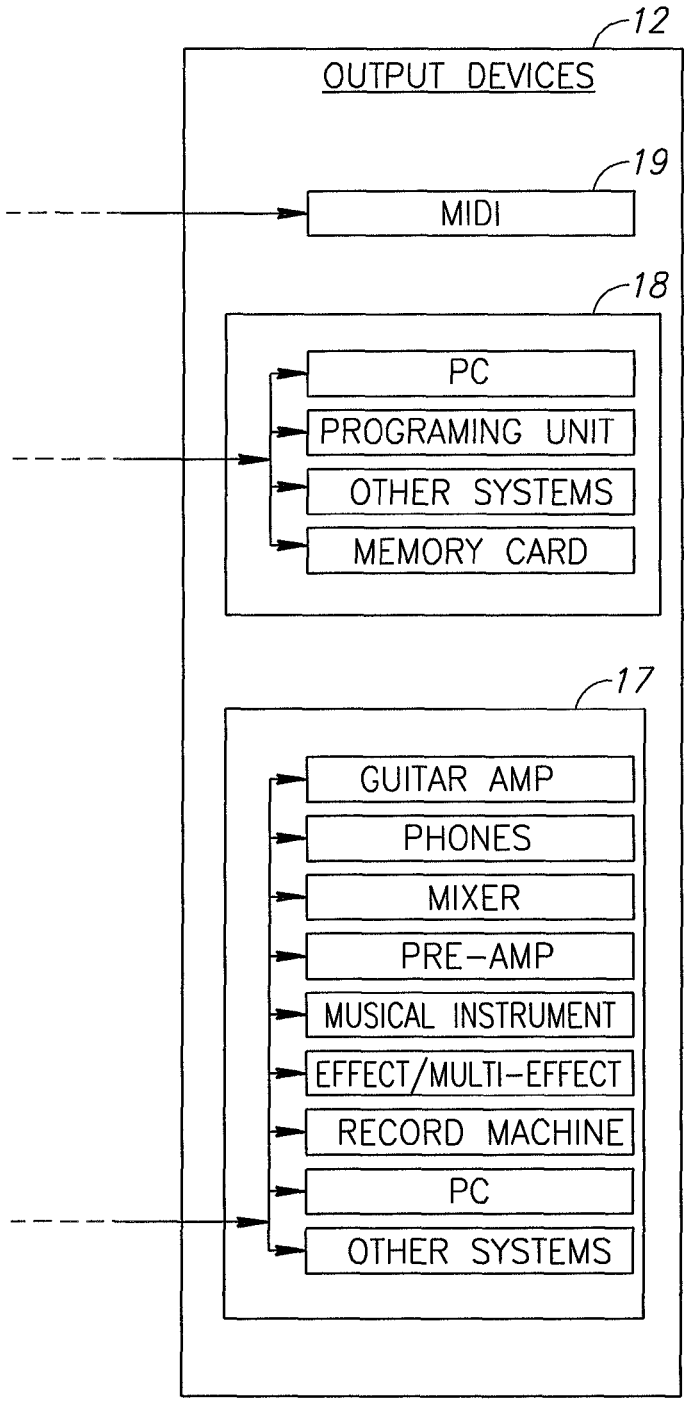
Figure 1 cont. PRIOR ART
Figure 2:
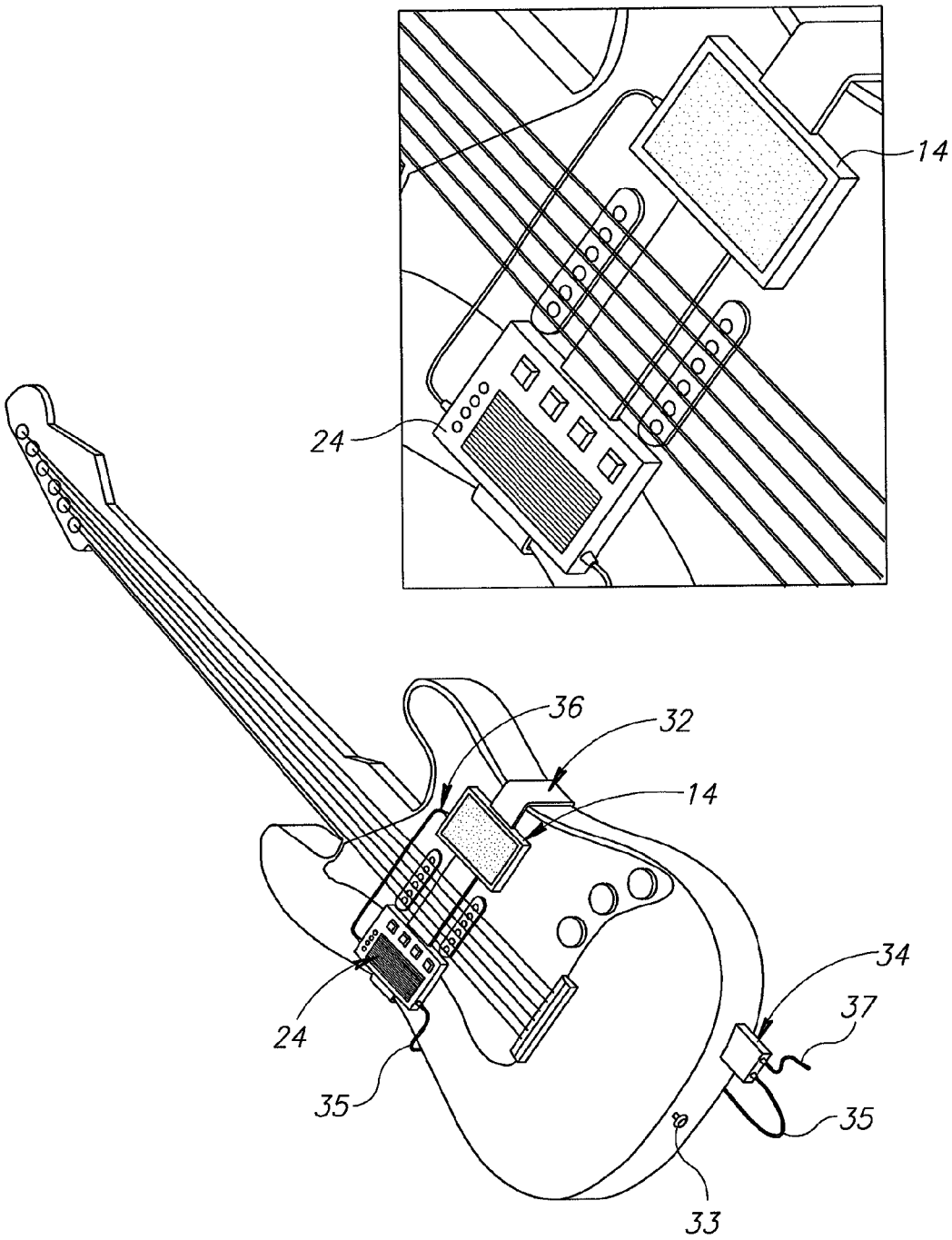
Figure 2 PRIOR ART
FIG. 2 is an illustration of the manner in which the system's inner components and the Dynamic Control Unit (DCU) are mounted upon the guitar according to the prior art.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

For a better understanding of the invention, the usages of the following terms in the present disclosure are defined in a non-limiting manner:

The terms "guitar" and "amplified guitar" as used herein in this application, are defined as any type of guitar (plucked string instrument having a body and a neck and played with the fingers and/or a pick) that generates an audio signal which is electrically transmit, and thereby modified and amplified. Explicitly, the term "guitar" as used in this application includes electric and bass guitars in which the signal is generated by pickups from the vibration of the strings, amplified acoustic guitars in which the signal is generated by a microphone receiving the sound from the guitar body and depend on the acoustic characteristics of the guitar, Synthi guitars in which special pickups identify the notes played by the guitarist and generate corresponding artificial sound, digital guitars utilizing various means to receive sound related inputs from the guitarist (e.g. optical pickups) and generate related digital signals. The body of the guitar may be any of any form, including a full or hollow body (e.g. made of wood, plastic or metal). The term "guitar" as used in this application further includes body-less plucking instruments (i.e. silence guitars and alike) and may even include other string instruments, e.g. instruments played with a bow such as violin or cello. Any type of pickup may be used to receive the signal from the guitar.

The term "playing the guitar" as used herein in this application, is defined as any method of generating sounds from the guitar such as plucking or picking with either the right or the left hand, or using a bow or other appliances. "Playing the guitar" further comprises fretting the strings with either the right or the left hand. The hand used to fret the guitar is defined as the fretting hand, while the other hand is defined as the picking hand. Fretting and picking may be carried simultaneously and/or alternately by one of the hands, and operating the invention may also be carried out by either or both hands.

The term "electric audio signal" as used herein in this application, is defined as the electronic signal that is produced by playing the guitar. The electronic signal is processed and transformed into the guitar audio signal. The electric audio signal may include some processing of the signal received by the pick ups, and may be analog or digital.

The term "sound effect" as used herein in this application, is defined as any manipulation of the basic guitar sound, and may include overdrive, distortion, fuzz, compressor, limiter, expander, gate, graphic equalizer, chorus, flanger, phaser, wah-wha, pitch shifter, harmonizer, tremolo, vibrato, uni vibe, ring modulator, talker, delay effects, reverb effects and various kinds of simulation effects, which enable the simulation of different preamps, amps, rotating speaker, guitars, cabinets, pickups and stomp-boxes.

Parameters and characteristics of sound effects, as used herein in this application, may comprise for example (i) gain, tone and level for distortion, overdrive and fuzz, (ii) speed, depth, feedback/regenerator and width for modulation effects such as chorus, flanger, vibrato, tremolo, ring modulation and Lesley effect, (iii) notch, peak and resonance for filters such as wah wah, talkers, resonant filter, phaser and uni-vibe, (iv) pitch shift and additional harmonics for pitch shifter, harmonizer and detune effects, (v) time and feedback for delay effects such as echo, reverse delay and ping pong delay, (vi) environment characteristics for reverb effects, (vii) threshold, ratio, level, attack and release times, and gain for dynamic effects such as compressor, limiter, expander, as well as parameters of (viii) noise gates and other sound parameters (e.g. volume).

The term "touch sensitive sensor" as used herein in this application, is defined as any device that measures touches and their characteristics, such as a touch-pad, a touch-screen, a sliding potentiometer, a roller potentiometer, push buttons, a tracking-ball, a dynamic ribbon, a joystick, a mouse, optical sensor array, infrared sensors or a combination thereof. The touch sensitive sensor may be any kind of a surface that may be used to identify a finger touch upon the surface, either as an integrated touch pad or as a combination of a surface and sensor(s), including touch sensitive sensors that are operational on other devices such as communication devices and data processing devices. The touch sensitive sensor may measure location and pressure the touches, as well as multiple touches. The touch sensitive sensor may comprise any type of touch pad, as well as a multi touch trackpad, and may further be somewhat flexible to enhance a touching feel.

One of the reason different instruments sound differently is the way they produce sound. Similar notes played by different instruments have a similar basic frequency yet differ in their timbre due to various sound parameters such as the composition of harmonies in the sound, spectrum width and ADSR parameters such as the sound envelope. A sound may be defined in respect to time and frequency and be characterized by relative amplitudes of each of the included frequencies over time.

The attack and decay of the sound influence the instrument's character. Sound production is characterized by the ADSR (Attack Decay Sustain Release) envelope that defines the way sound is produced. Attack time is the time taken for initial run-up of level from nil to peak. Decay time is the time taken for the subsequent run down from the attack level to the designated sustain level. Sustain level is the amplitude of the sound during the main sequence of its duration. Release time is the time taken for the sound to decay from the sustain level to zero after the key is released.

Embodiments of the current invention comprise a system and method of changing any of the sound characteristics (e.g. ADSR and ASDSR sound envelopes, frequency range and intensity) of the guitar sound using a touch sensitive sensor.

The system allow the player to generate sound by touching or tapping touch sensitive sensor 110 without picking the strings. Sound may then be taken from the guitar according to the positions of the fretting hands. String vibrations may be generated (at least before using touch sensitive sensor 110) by either an initial strum, or using the fretting hand (e.g. by hammer on and by pulling the strings).

FIGS. 3A-3D are schematic block diagram illustrations of a sound manipulator, according to some embodiments of the invention. Sound manipulator 100 comprises a touch sensitive sensor 110 connected to a processing unit 120.

Processing unit 120 is arranged to receive electric audio signal 200 associated with instrument 90 that is played simultaneously during the finger tapping. Instrument 90 may comprise an amplified guitar of any kind, a synthi guitar, or any other stringed or non-stringed instrument. Electric audio signal 200 may be associated with an electronic instrument producing a synthesized signal 200.

In particular, embodiments of the invention comprise an amplified guitar comprising sound manipulator 100 embedded therein, built into the guitar body or attach thereupon, with electric audio signal 200 being a signal from the guitar pickups, that may be further modified by various electronical means and comprise sound effects.

Figure 4:
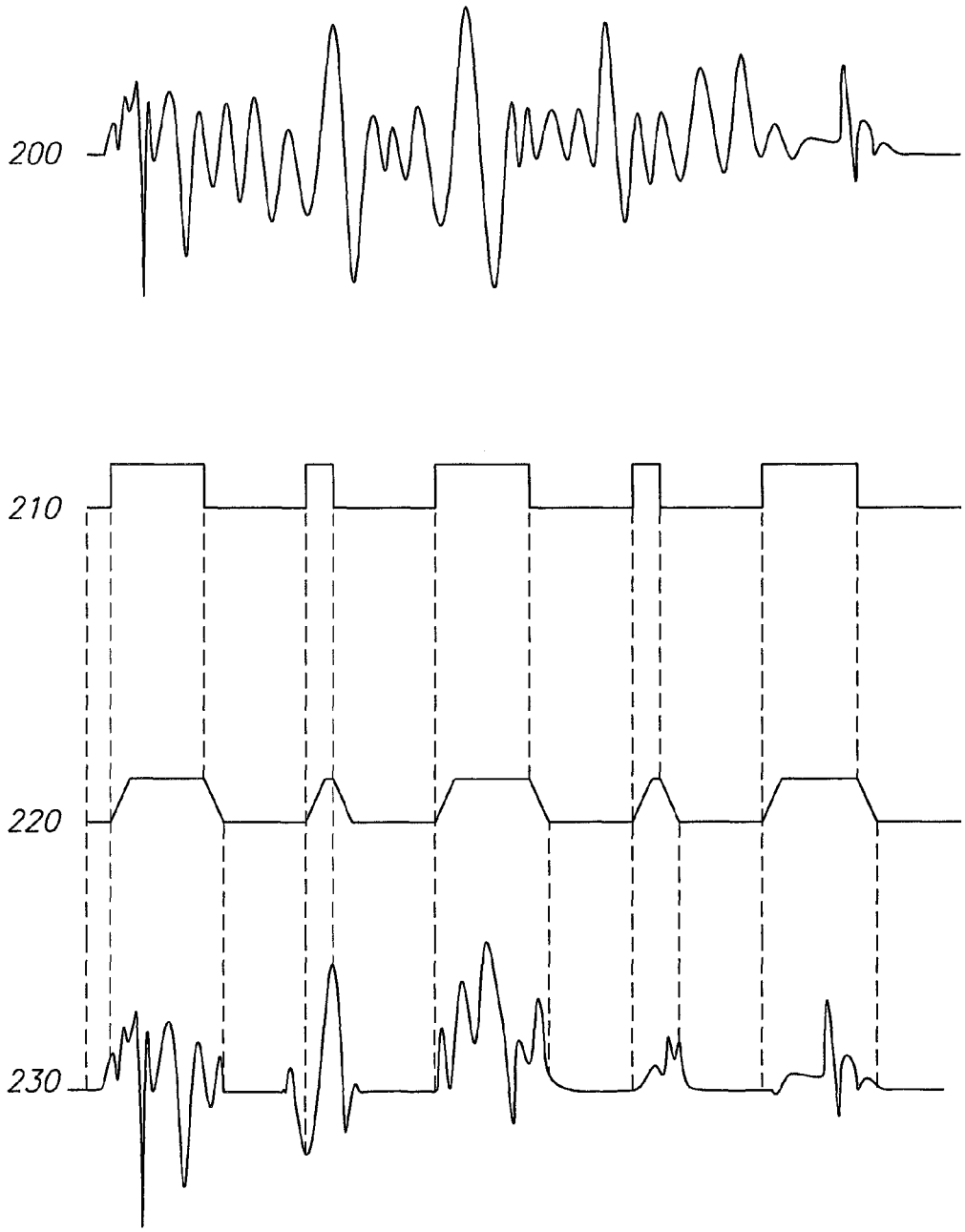
FIG. 4 is a schematic illustration of an electric audio signal associated with an instrument, a corresponding time dependant tapping signal, with a common time base, a modified time dependant signal, and a modified electronic signal exemplifying the operation of the sound manipulator, according to some embodiments of the invention.

FIG. 4 is a schematic illustration of an electric audio signal 200 associated with an instrument 90, a corresponding time dependant tapping signal 210, with a common time base, a modified time dependant signal 220, and a modified electronic signal 230 exemplifying the operation of sound manipulator 100, according to some embodiments of the invention.

Touch sensitive sensor 110 may be responsive to the location, pressure and tapping speed and intensity of the finger(s) applied to it. Touch sensitive sensor 110 is arranged to detect finger tapping that comprises finger contact upon touch sensitive sensor 110 ("touch") and finger detachment from touch sensitive sensor 110 ("release").

Adding touch sensitivity sensor like touch pad to the guitar provide the guitar player with a new way to play guitar. The touch pad can be used as a Sound-Gate which means that no sound will be produce unless the pad is in touch. In this case, the guitar player will play the guitar chord or solo notes with his fretting hand in a standard manner, but he will use his picking hand to rhythmically tap the pad to produce some kind of sharply slices sound with a finger tapping beat.

This gives the guitar player an opportunity to produce slice sounds in a similar manner to the sounds produced by keyboard players where they are pressing releasing rhythmically chord or notes using a synthesizer keyboard.

Furthermore, the touch pad can be used booth as a Sound-Gate and effect controller allowing different sound to be produce only and according to the finger contact point on the pad.

As for example, the pad X axis can be assigned to control the amount of pitch shifting (say from 0 to one octave above) and the pad Y axis can be assigned to control the wahwah filter range (say from 50 Hz to 2500 Hz). By playing guitar chord or notes with his fretting hand while simultaneously tapping the pad in different X-Y locations with his picking hand the guitar player can sharply manipulate the guitar sound characteristic providing a variety range of slice sounds, which allows using the guitar in new types of music in which the guitar is currently not used, such as pop, dance and trance music. Each axis may be associated with several parameters, e.g. X axis with wah wah and gain, Y axis with pitch and tremolo speed.

Controlling the sound in this manner also allows developing new directions in rock music and new guitar playing styles.

The Sound-Gate can be program to operate that no sound will be produce only when the pad is in touch, this gives the guitar player the abilities to play the guitar in regular manner while combining part of rhythmically muting sound possibilities whenever he tap the pad.

Another feature of the Sound-Gate that it can be programmed to record slicer patterns and play them according to the guitar player commands.

Using touch sensitive sensor 110 may be simultaneous or sequential to plucking the strings. Touch sensitive sensor 110 may be used to initiate the sound from plucked strings, replace plucking, or define time periods in which the sound is produced, muted, or manipulated in different ways (e.g. different sound effects are added). For example, touch sensitive sensor 110 may be used to define a temporal pattern, processing unit may define buffer sizes that correspond to the temporal pattern, and while playing, the sound may be fitted into the buffer size pattern repeatedly by starting over the buffer size pattern at the end of each buffer size pattern.

The characteristics of touching touch sensitive sensor 110 may be associated with specific ADSR parameters, for example such that emulate keyboard sound or percussion sound on the basis of the played guitar sound.

Several touch sensitive sensors 110 may be positioned at various location on instrument 90, e.g. on the body and on the neck of a guitar, or above and below the string. Different touch sensitive sensors 110 may be associated with different functionalities, according to the preferences of the player.

Two touch sensitive sensors 110 may be tapped with different fingers, for example a lower touchpad may be tapped with the pinky finger and an upper touchpad with the thumb, such that a rhythmic movement with the wrist allows tapping both pads.

In another embodiment, two touch sensitive sensors 110 may have different functions—e.g. the one may control turning sound effects on and off, while the other may control sound effect parameters.

Any touch sensitive sensors 110 may be arranged to allow multi touch inputs relating to various parameters.

Touch sensitive sensor 110 may be arranged to detect simultaneous touches by several fingers, and special effects or parameters may be associated therewith. E.g. a certain sound effect may be operated or activated upon detection of two fingers touching touch sensitive sensor 110, while movement of one finger on the pad may change their parameters.

In another example, location of touching touch sensitive sensor 110 may correspond to a designated string in a system of string designated pickups. Touch sensitive sensor 110 may be used to designated specified effects to each string separately.

Touch sensitive sensor 110 is arranged to generate a corresponding time dependant tapping signal 210 comprising a first state 212 corresponding to periods in which the finger contacts touch sensitive sensor 110 and a second state 214 corresponding to periods in which the finger does not contact touch sensitive sensor 110. First state 212 may either be higher or lower than second state 214. Any of states 212, 214 may represent essentially unaltered electric audio signal. Any of states 212, 214 may correspond to a partly or fully muted electric audio signal. Each one of states 212, 214 may correspond to a different modification of electric audio signal 200.

For example, touching touch sensitive sensor 110 may allow sound pass through the system ("muter on release"), while during periods touch sensitive sensor 110 is not touched sound may be muted. In this example, tapping touch sensitive sensor 110 may replace picking the strings by the pick. This method may imitate keyboard sound production. Moreover, the system produces sound associated with all strings simultaneously, while picking produces sound from the string sequentially. Compressing or distorting the sound before applying touch sensitive sensor 110 functionality creates sustain than enhance the effect, and make it more easy to produce sound by pressing on the string with the fretting hand. Touch sensitive sensor 110 may be used to directly produce sound according to fretted notes, instead of picking the strings. Touch sensitive sensor 110 may allow playing with additional fingers which picking the strings. Touch sensitive sensor 110 may be used to either or both generate sound and manipulate picked sound.

In another example, touching touch sensitive sensor 110 mutes the guitar sound, generating abrupt discontinuations of the sound ("muter on touch"). In this technique, combining regular playing and tapping generates continuous changes between these two sound types.

Touch sensitive sensor 110 may be further arranged to detect finger positions upon touch sensitive sensor 110 and generate the corresponding time dependant tapping signal 210 in relation to the detected finger positions according to specified rules, to yield differing time dependant tapping signals 210 for different finger positions.

"Muter on release" may be combined with sound effect parameter determination by the X and Y location of the hand touching touch sensitive sensor 110.

Various areas on touch sensitive sensor 110 may be defined to produce sound with different pitch in respect to the original sound, e.g. an octave above or below a fretted note. intermediate areas between two defined areas may generate sound of intermediate characters, e.g. a left region on touch sensitive sensor 110 may generate the original pitch, a right area on touch sensitive sensor 110 may generate the sound an octave higher, and touching the middle area of touch sensitive sensor 110 generates an intermediate sound, according to its distances from the left and the right regions of touch sensitive sensor 110. Alternatively, only predefined pitch changes may be allowed. The Y axis may be used to add effects upon these pitch changes, e.g. a wahwah effect with a filter position depending on the vertical position of the finger.

Touch sensitive sensor 110 may be further arranged to detect finger pressure on touch sensitive sensor 110, and processing unit 120 may be arranged to adapt the received at least one state change characteristic according to the detected finger pressure and tapping intensity.

Tapping intensity (or "velocity") in a "muter on release" mode may be used to determine the volume of the produced sound. Sound effect parameters may also be determined by the tapping intensity, e.g. distortion gain.

In combination, touch sensitive sensor 110 in a "muter on release" mode may change pitch and distortion gain according to touch location on the X axis, change the size of reverb space and the opening of the resonance filter according to touch location on the Y axis, and change overall volume according to tapping intensity. This combination generates unique guitar sound when tapping the pad.

Various sound effects 91, 92, 93, 94, 96 may be applied to the basic sound, and various parameters of the sound effects may be changed using touch sensitive sensor 110.

For example, in order to enable a continued rhythmical pattern, the signal from the guitar pickups may be compressed or sustained. The sustainment of electric audio signal 200 may be used to generate a percussion-like effect on fretted notes, thereby allowing the player to pick and/or tap the fretted notes simultaneously.

Some sound effects 91 such as compression and sustain, may be added to electric audio signal 200 before multiplying modified time dependant signal 220 thereupon, in order to enhance the effects of the multiplying. Other sound effects 92 may be applied to modified electronic signal 230. Moreover, some sound effects 93, 94, 96 may be applied to electric audio signal 200 only in association with taps on touch sensitive sensor 110.

Touch sensitive sensor 110 may be positioned on the amplified guitar, and modified electronic signal 230 may comprise modifications that comprise at least a partial muting of electric audio signal 200; at least a partial muting of sound effects incorporated in electric audio signal 200; and changes of sound effect characteristics. The modifications may be determined by a player of the amplified guitar both by defining the at least one state change characteristic and by a connection position of touch sensitive sensor 110 within an assembly of sound effects connected to the amplified guitar. The position of touch sensitive sensor 110 among the assembly of sound effects may determine the sound effects on which the modifications (by tapping) are applicable, and the sound effects that are added upon modified electronic signal 230.

Processing unit 120 is further arranged to receive at least one state change characteristic, which may comprise any of the following: an association of "touch" and "release" with the first and the second states; an attenuation state associated with at least one of the states; and types of transitions in the modified electronic signal upon changes of the tapping signal between states.

The association of "touch" and "release" with first and second states 212, 214 may be that a "touch" determines first state 212 or second state 214 and that a "release" determines second state 214 or first state 212 respectively. Differing associations may correspond to differing finger positions on touch sensitive sensor 110.

FIGS. 5A-5H illustrate various signal characteristics that may be adjusted by sound manipulator, according to some embodiments of the invention.

Figure 5A:
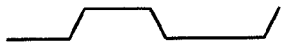
FIGS. 5A-5H illustrate various signal characteristics that may be adjusted by sound manipulator, according to some embodiments of the invention.
Figure 5B:
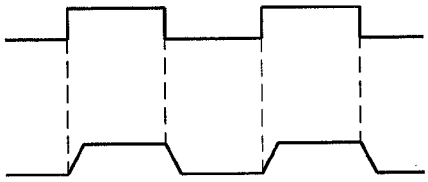
Figure 5C:
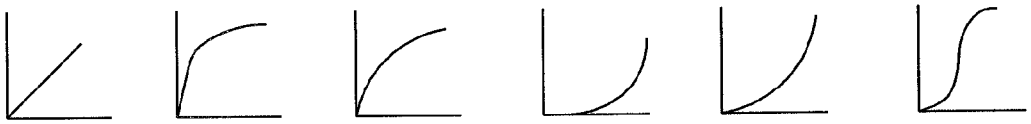
Figure 5D:
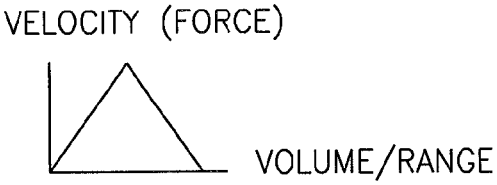

State change may be abrupt or gradual, in correspondence with touch and release characteristics (FIG. 5A), or differing from touch characteristic in specified ways (FIG. 5B).

Attack and decay of taps in modified time dependant signal 220 may be defined by various curves (FIG. 5C) thereby defining the ADSR envelope of the sound that is passed through by signal multiplication and results in modified electronic signal 230. The exact form of modified time dependant signal 220 may comprise an attack curve, a decay curve that are user determined. Curve types may be either inputted by touch sensitive sensor 110 or selected from predefined options. Durations of application of each curve may be determined by a duration of touch on touch sensitive sensor 110.

Touch sensitive sensor 110 may be arranged to determine sound effect parameters by either location of the touch, pressure applied on touch sensitive sensor 110, duration of the touch, or intensity of tapping (also termed "velocity", FIG. 5D)—the temporal derivative of the pressure applied on touch sensitive sensor 110. Various parameters may be determined by characteristics and combinations of the above. E.g. a brief tap may designate a low gain, a longer tap may designate a high gain. Moving a finger over touch sensitive sensor 110 may be used to characterize smoothly varying parameters (e.g. pitch or wah's). Slow tapping may define a longer reverb while abrupt tapping may designate reverb dismissal.

Tapping intensity may determine sound effect parameters such as filter width, or even the pitch. Filter width or filter shifts may be determined by the intensity of tap. An intense tap may generate a note at a specified interval from the basic tone, and a weak tap may not generate such a note or generate a note at a specified smaller interval.

Figure 3A:
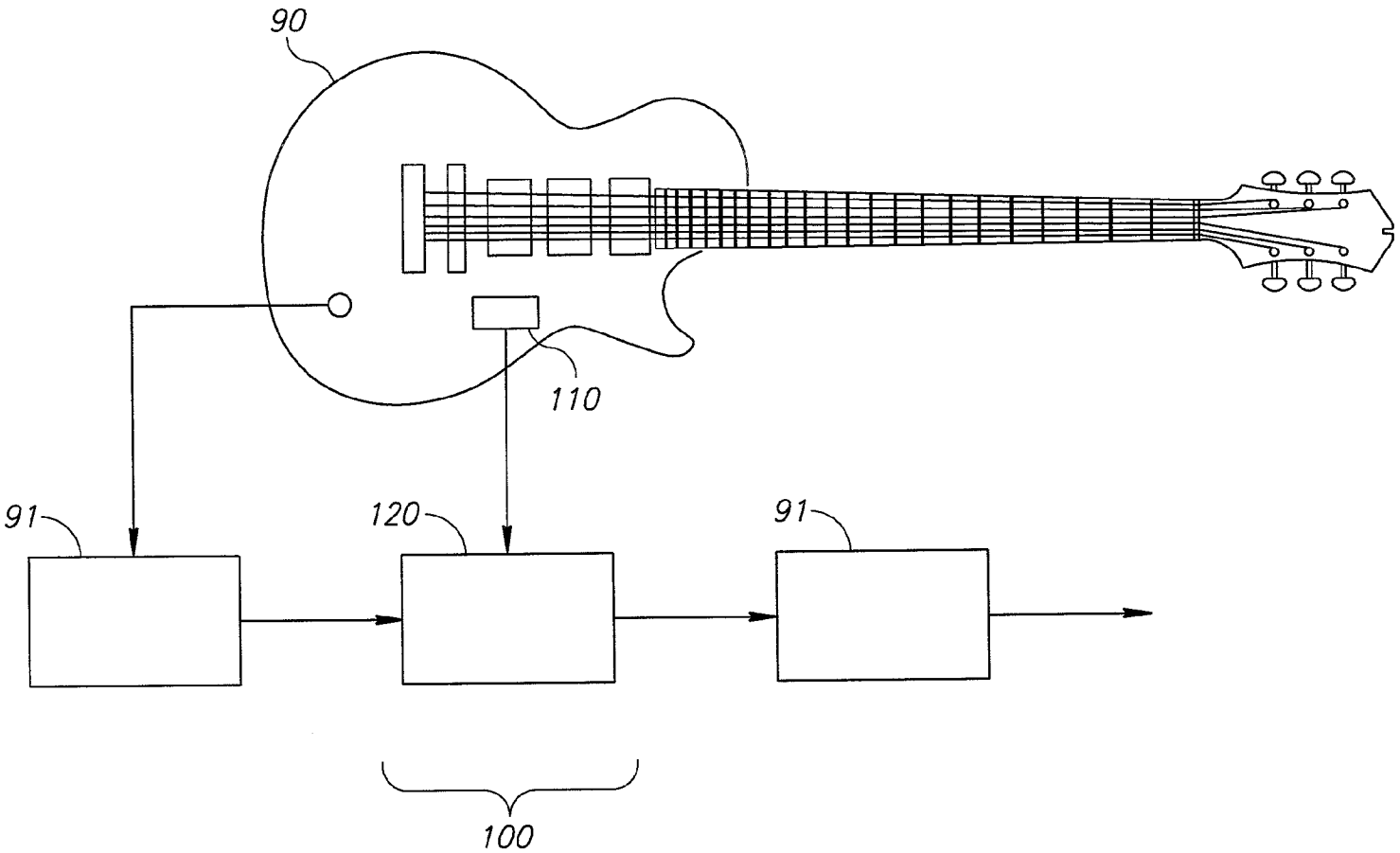
FIGS. 3A-3D are schematic block diagram illustrations of a sound manipulator, according to some embodiments of the invention.
Figure 3B:
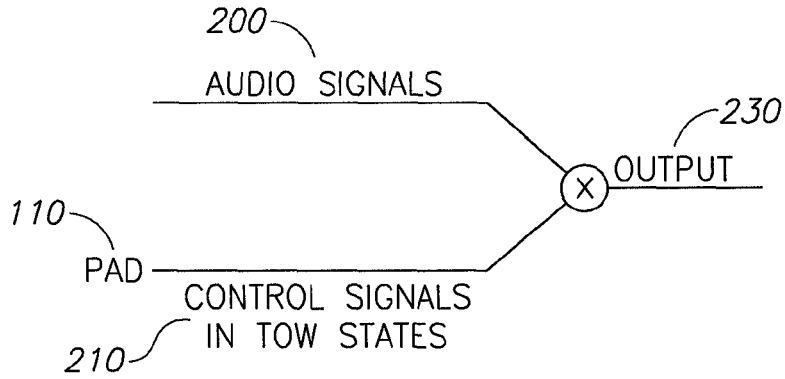
Figure 3C:
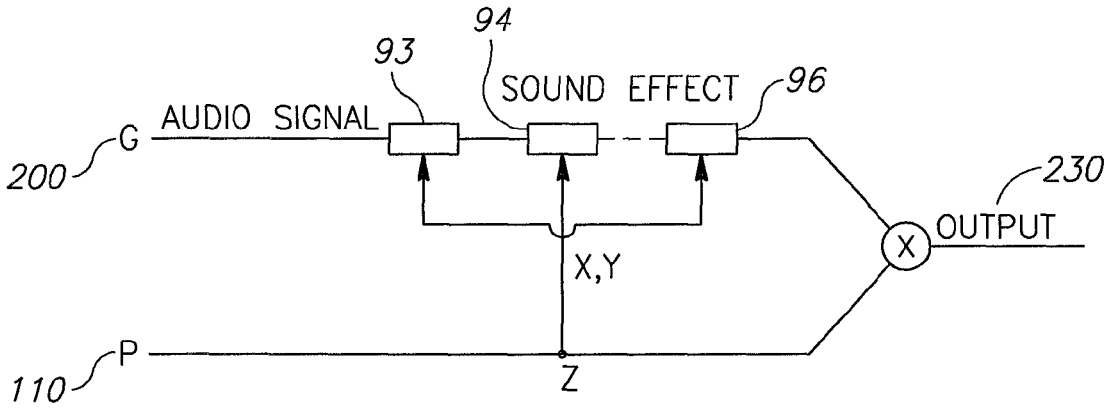

The location of the tap may also determine such sound effect parameters, such that x position, y position, intensity and duration of each tap may define different sound effect parameters and sound effect combinations (FIG. 3C).

Expression pads may also be controlled by touch sensitive sensor 110, in a similar manner to sound effects.

Figure 5E:
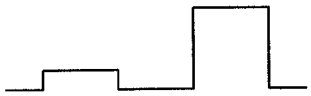

Either touch sensitive sensor 110 or processing unit 120 may assign different state amplitudes to the taps (FIG. 5E). At touch sensitive sensor 110, state amplitudes may correlate with the intensity of each tap. At processing unit 120, state amplitudes may be pre-programmed.

Figure 5F:
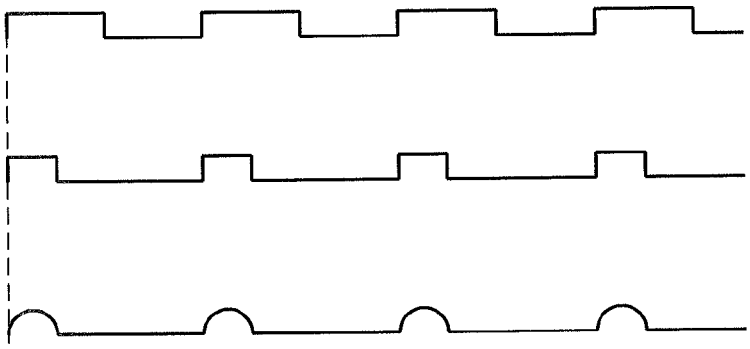
Figure 5G:
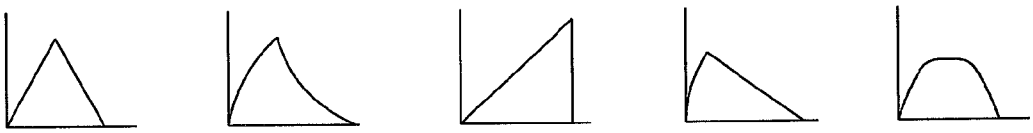
Figure 5H:
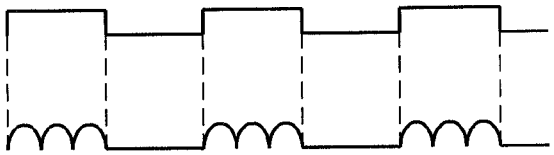

Taps (of tapping signal 210), which represent state changes (either between touch and release or between release and touch, or both, with different parameters) may be selected to have various specified forms (dictating various corresponding ADSR envelopes for the sound 210 of instrument 90, resulting in modified sound 230) as presented in FIG. 5F—various extents and forms of the ADSR envelope, FIG. 5G—various forms, attack and decay forms of the ADSR envelope, and FIG. 5H—multiple recurring ADSR envelopes in each tap.

State change characteristics may comprise an attenuation state associated with either first or second state 212, 214. For example, electric audio signal 200 may be fully muted (either upon touch or upon release), or attenuated to a specified state (e.g. to 40% upon touch or upon release). Parts of electric audio signal 200 may also be attenuated, such as specific sound effects. One of first or second state 212, 214 may correspond to by passing the sound effects on producing the basic sound of instrument 90 (when electric audio signal 200 comprises a basic signal and mixed sound effects).

The modification of the mixed sound effects may comprise initiating the effect; changing a parameter of the effect; changing an intensity of the effect; and terminating the effect.

The modification of the basic signal may comprise initiating the basic signal; changing a volume of the basic signal; changing a pitch of the basic signal; and terminating the basic signal.

Differing finger positions on touch sensitive sensor 110 may correspond to different attenuation states or to different parts of electric audio signal 200 (e.g. specific sound effects or specific characteristics of the basic sound) such that tapping at different positions on touch sensitive sensor 110 yields different types of modifications of modified electronic signal 230.

State change characteristics may comprise types of transitions in modified electronic signal 230 upon changes of tapping signal 210 between states 212, 214. In particular, transitions corresponding to state changes may be designed to avoid a ticking sound upon switching between states 212, 214 (on touch or on release). Various gradual transitions may be forced upon either tapping signal 210 or modified electronic signal 230, and these may be selected either at processing unit 120 or by touch specific positions on touch sensitive sensor 110.

Touch sensitive sensor 110 may further be arranged to detect finger movement upon touch sensitive sensor 110, and processing unit 120 arranged to adapt the modification according to the detected finger movement.

Processing unit 120 may be further arranged to modify time dependant signal 210 corresponding to the finger tapping according to the state change characteristics. Alternatively, processing unit 120 may be arranged to modify modified electronic signal 230 according to the state change characteristics.

Processing unit 120 is further arranged to multiply, with a common time base, modified time dependant signal 220 with electric audio signal 200, to yield modified electronic signal 230, wherein changes of modified electronic signal 230 during changes between first and second states 212, 214 of tapping signal 210 are characterized by the state change characteristics.

As an example, modified electronic signal 230 may substantially equal electric audio signal 200 during substantially the duration of first or second state 212, 214, and substantially equal a low volume version of electric audio signal 200, characterized by the state change characteristics during substantially the duration of second or first state 214, 212 respectively.

Electric audio signal 200 may comprise a basic signal and at least one mixed sound effect, which may be independently modified by tapping. For example, processing unit 120 may multiply, with a common time base, modified time dependant signal 220 with either the basic signal and/or the sound effect to yield modified electronic signal 230. The multiplying of modified time dependant signal 220 with electric audio signal 200 may comprise differing specified sound effect compositions for first and second states 212, 214.

Sound manipulator 100 may operate for example according to the touch and release periods and characteristics as described above. In embodiments, various aspects of the touch profile may be pre-programmed (either via touch sensitive sensor 110 or independently) such as to be activated by actual touch in a specified way. For example, touch duration and intensity may be pre-programmed. Sequences of pre-programmed touch profiles may be associated with each touch. Sound manipulator 100 may additionally comprise a module arranged to fit a tapping pattern onto a specified temporal grid.

Figure 6:
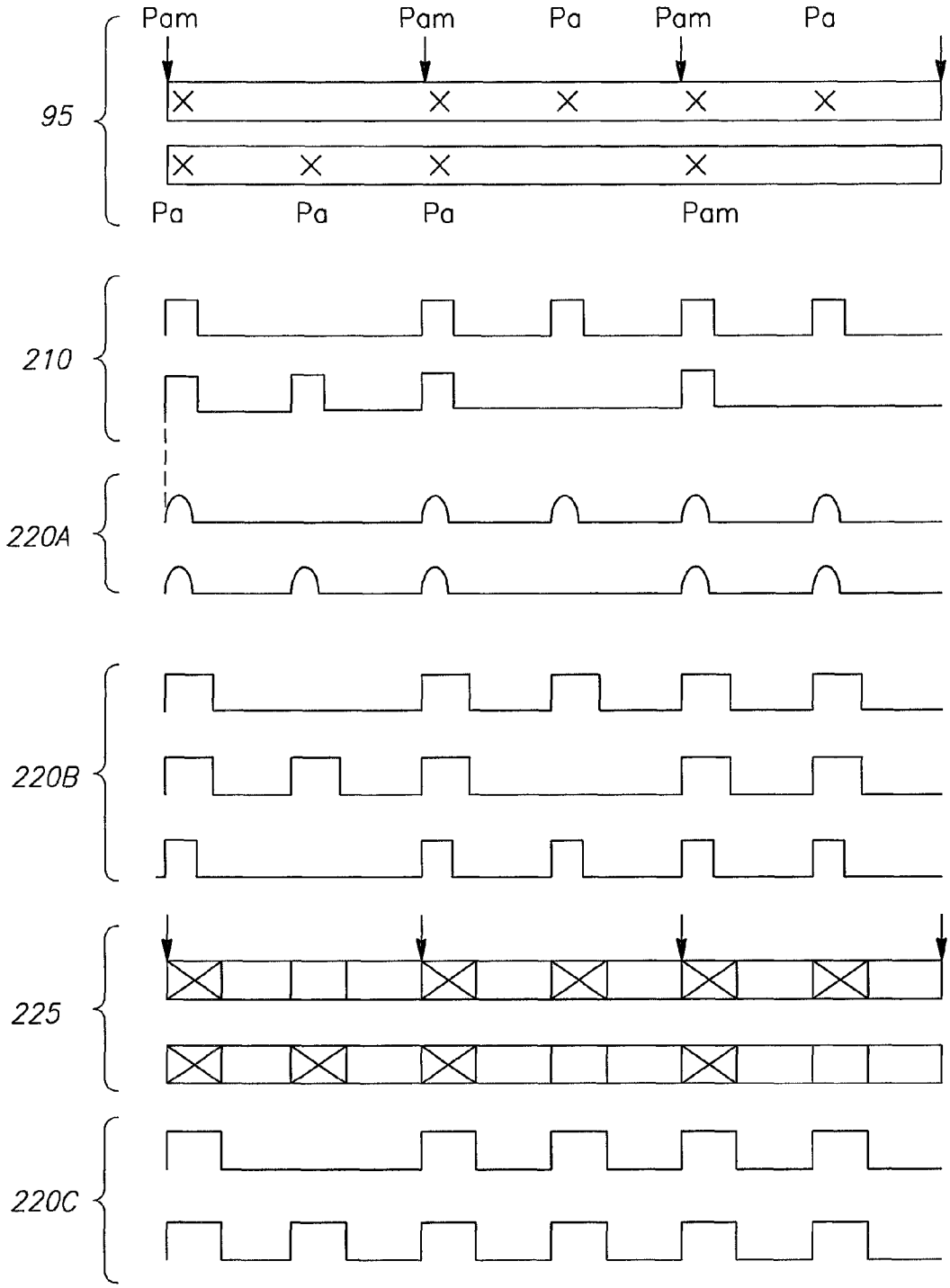
FIG. 6 illustrates signal manipulation by a quantization module of the sound manipulator, according to some embodiments of the invention.

FIG. 6 illustrates signal manipulation by a quantization module 160 of sound manipulator 100, according to some embodiments of the invention.

Figure 3D:
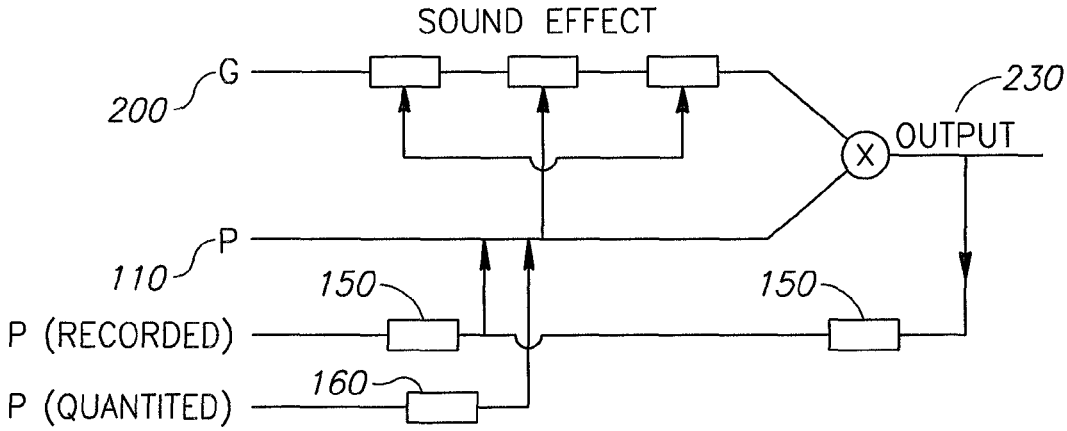

As shown in FIG. 3D, sound manipulator 100 may comprise a quantization module 160 arranged to fit time dependant tapping signal 210 onto a specified temporal grid, such as to allow synchronization of modified electronic signal 230 with other electronic signals having their temporal grids.

Quantization module 160 may allow the player to program a pattern and define a tempo (e.g. number of bit per minute) and to fit the programmed pattern to defined tempo. The fitting may be adjusted manually.

States 212, 214 may correspond to buffer sizes which may be determined by tapping and adjusted to a time grid. These buffer sizes may then be used to manipulate played sound according to the state change characteristics. A given pattern of buffer sizes may be used to manipulate played sound according to the state change characteristics repetitively, according to player commands inputted on touch sensitive sensor 110. The buffer sizes may be used to synchronize real time playing or recorded sound with other instruments or with other recorded sound, as well as to synchronize real time playing with a given beat. The sequence of buffer sizes may be started over continuously to generate a long pattern of recurring buffer size distribution loops to be used to change a continuously incoming signal.

The tempo may be defined according to the tapping tempo, according to an inputted beat rate (manually or electronically per communication), or by analyzing the tempo of the incoming electric audio signal or of a pre-recorded track.

The fitted pattern may be operated manually by touching touch sensitive sensor 110, as a single or recurrent pattern, or may be stopped manually by touching touch sensitive sensor 110. Quantization module 160 thus allows incorporating patterns that were previously recorded (with touch sensitive sensor 110, and with fitting to a specified tempo) within a current playing session.

In the example presented in FIG. 6, signal 95 represent an actual tapping to the player. Signal 95 is generates by touch sensitive sensor 110 time dependant tapping signal 210, which may be modified to modified time dependant signal 220 by changing tap signal form (220A), tap signal duration (220B) or intensity, and also the timing (220C) by attaching the tapped signal to a specified temporal grid 225 that allows synchronizing the tapping with other instruments, and generate tapping patterns that may be played and adjusted in later playing.

Quantization module 160 may be used to synchronize instrument 90 with other instruments, e.g. during studio recordings or during live play, by either electronically processing the temporal grids to fit, or by manually (e.g. live) adjustment of the specified temporal grid (e.g. of a recorded tapping pattern) by the player using touch sensitive sensor 110 itself to fine tune the temporal grid.

As shown in FIG. 3D, sound manipulator 100 may further comprise a recorder 150 arranged to record time dependant tapping signal 210. Processing unit 120 may be arranged to generate modified electronic signal 230 from the recorded played time dependant tapping signal and the simultaneous electric audio signal 200 upon a specified finger tap detected by touch sensitive sensor 110.

Processing unit 120 may apply the modifications relating to the recorded signal repeatedly, such as to generate a repeating pattern of recurring modifications, in association with electric audio signal 200 for which they were recorded or in association with freshly produced electric audio signals 200.

Recorder 150 may be controlled by touching touch sensitive sensor 110.

Sound manipulator 100 may comprise a communication module 170 arranged to allow to: transmit the signals from touch sensitive sensor 110 to processing unit 120 and/or transmit electric audio signal 200 to processing unit 120 and/or transmit modified electronic signal 230 from processing unit 120 to a control unit 180 which may manage touch sensitive sensor 110, various characteristics of its operation and sound effects.

Multiple ADSR envelope manipulators 100 may be connected in any configuration in respect to various effects (examples are: sustain; compression; overdrive; delay; reverb; wah-wah; techno-wah; chorus; tremolo; talkers; and flanger) to allow modification of any of them according to the order of connection. Sound manipulator 100 may be connected to control unit 140 and the parameters of the modifications may be control either via control unit 140 or via touch sensitive sensor 110 in communication therewith.

Touch sensitive sensor 110 may attachable or connected to an amplified guitar, such that processing unit 120 receives the electric audio signal generated by the amplified guitar. The connection of touch sensitive sensor 110 to the amplified guitar may be permanent, or touch sensitive sensor 110 may be attached to and detached from the amplified guitar at varying positions and times.

Touch sensitive sensor 110 may be attached to the amplified guitar such as to allow positioning fingers of either the picking hand, the fretting hand or both onto touch sensitive sensor 110. For example, touch sensitive sensor 110 may be positioned in the vicinity of the picking hand to allow simultaneous picking the strings and tapping touch sensitive sensor 110, or touch sensitive sensor 110 may be positioned in the vicinity of the fretting hand to allow simultaneous fretting the strings and tapping touch sensitive sensor 110. Sound manipulator 100 may be integral in the amplified guitar.

Using sound manipulator 100 with the amplified guitar allows producing new types of sound from the electric. In particular, keyboard-like attack and abrupt discontinuation of notes is enabled for the first time. Furthermore, the keyboard-like attack and abrupt discontinuation may be applied to sound ingredients and to associated effects, singly or commonly. A gradual modification is further applicable via sound manipulator 100, e.g., by moving the finger to control a duration of the modification or its intensity.

Sound manipulator 100 may be used in association with various sound sources, starting from various guitar types, through other stringed instrument, and reaching synthesized sound that may as well be manipulated by sound manipulator 100.

Figure 7:
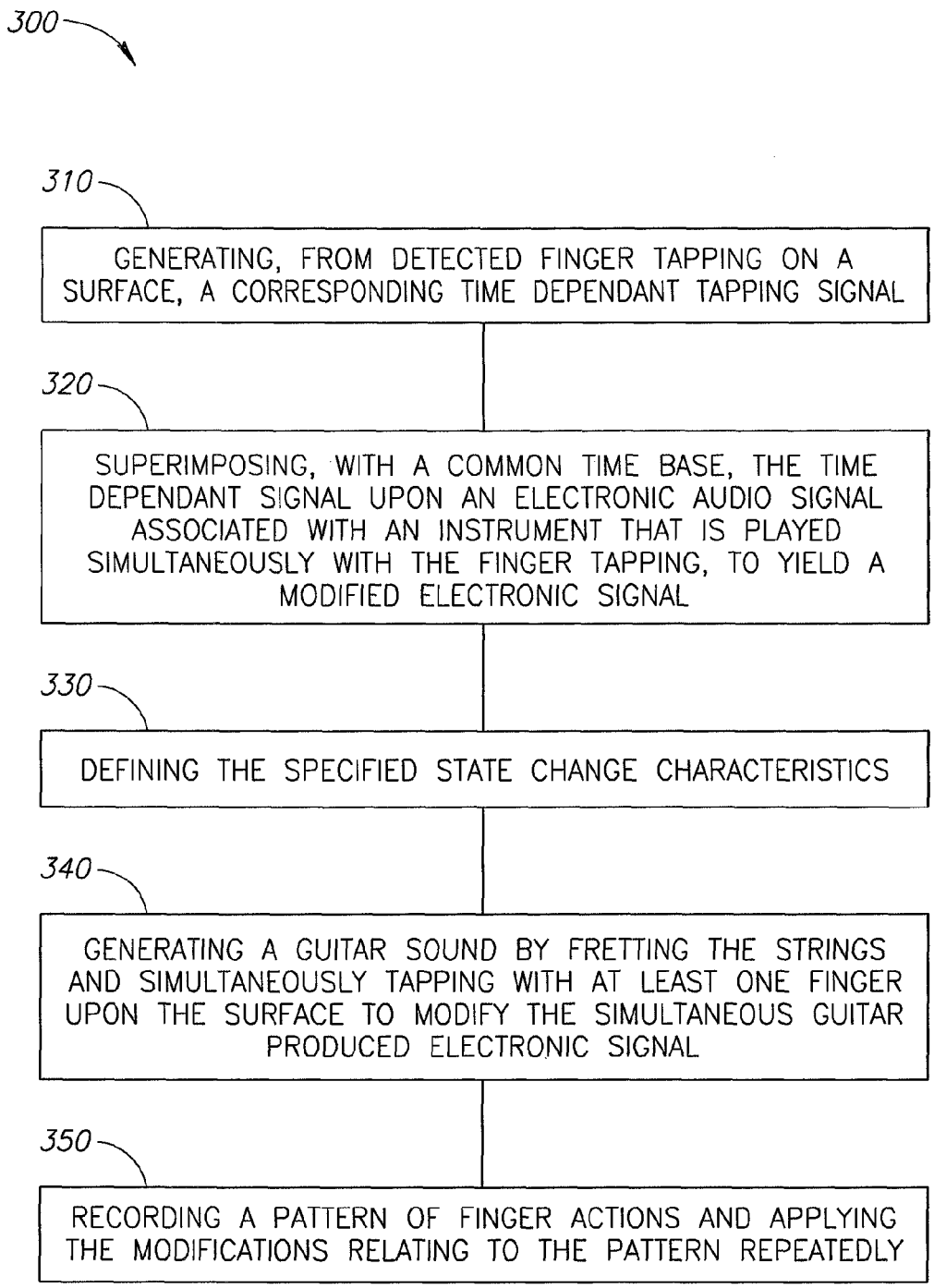
FIG. 7 is a schematic flow chart illustrating a method, according to some embodiments of the invention.

FIG. 7 is a schematic flow chart illustrating a method 300, according to some embodiments of the invention. Method 300 comprises the following stages: generating (310), from detected finger tapping on a surface, a corresponding time dependant tapping signal comprising a first state corresponding to periods in which the finger contacts the surface and a second state corresponding to periods in which the finger does not contact the surface; and multiplying (320), with a common time base, the time dependant signal upon an electric audio signal associated with an instrument that is played during the finger tapping, to yield a modified electronic signal.

Changes of the modified electronic signal during changes between the first and the second states of the tapping signal are characterized by at least one specified state change characteristic.

Method 300 may further comprise defining (330) the at least one specified state change characteristic comprises at least one of: an association of finger contact with the surface and finger detachment from the surface with the first and the second states; an attenuation state associated with at least one of the states; and types of transitions in the modified electronic signal upon changes of the tapping signal between states.

The modified electronic signal may comprise modifications that comprise at least one of: at least a partial muting of the electric audio signal; at least a partial muting of sound effects incorporated in the electric audio signal; and changes of sound effect characteristics.

Method 300 may further comprise generating (340) a guitar sound by fretting the strings and simultaneously tapping with at least one finger upon the surface to modify the simultaneous guitar produced electronic signal.

Method 300 may further comprise recording (350) a pattern of finger actions and applying the modifications relating to the pattern repeatedly.

A simple method to measure the frequency response is to use sine wave input and sweep the frequency over the audio spectrum 0-20 KHz. The power of the output represented in DB at each frequency point of the DUT (Device Under Test) is directly proportional to the frequency response.

Touch sensitive sensor 110 may be used to determine and manipulate a frequency response of modified electronic signal 230. Touch sensitive sensor 110 may be used to determine various frequency filters to manipulate the frequency response. For example, touch sensitive sensor 110 may emulate a graphic equalizer controlled by selecting filter levels as X,Y locations. Single filters (width and height) may be selected and controlled by touch sensitive sensor 110.

Touch sensitive sensor 110 may interpret a curve marked by a touch as a frequency response curve. This embodiment allows the player to easily determine a continuous frequency response. The continuous frequency response may be processed to produce an filter setting that is equivalent to the inputted frequency response curve.

Touch sensitive sensor 110 may be used to manipulate the harmonies that constitute electric audio signal 200 singly or groupwise, and add or remove various harmonies above or below the dominating pitch. For example, X axis regions on sensitive sensor 110 may be associated to specified harmonies in the sound and Y axis values may be used to define the amplitude of the respective harmony. In this way, touch sensitive sensor 110 allow controlling sound composition during playing the instrument.

The state change characteristic may comprise differing characteristics associated with differing finger positions on touch sensitive sensor 110, such that tapping at different positions on touch sensitive sensor 110 yield different types of modifications of modified electronic signal 230.

Figure 8A:
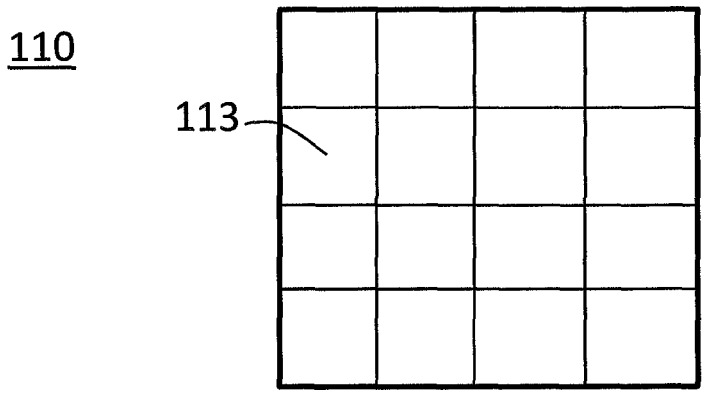
FIGS. 8A-8C illustrate the allocation of different areas on the touch sensitive sensor 110 to different combinations of state change characteristics, according to some embodiments of the invention.
Figure 8B:
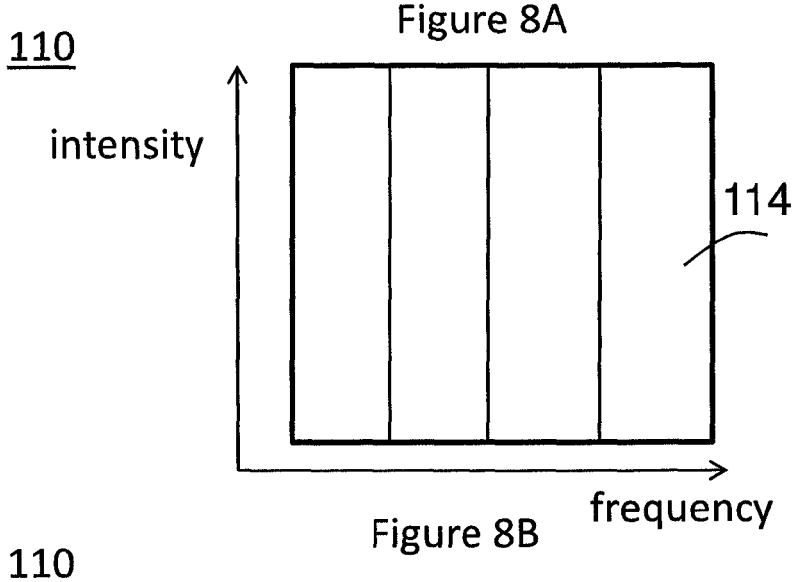
Figure 8C:
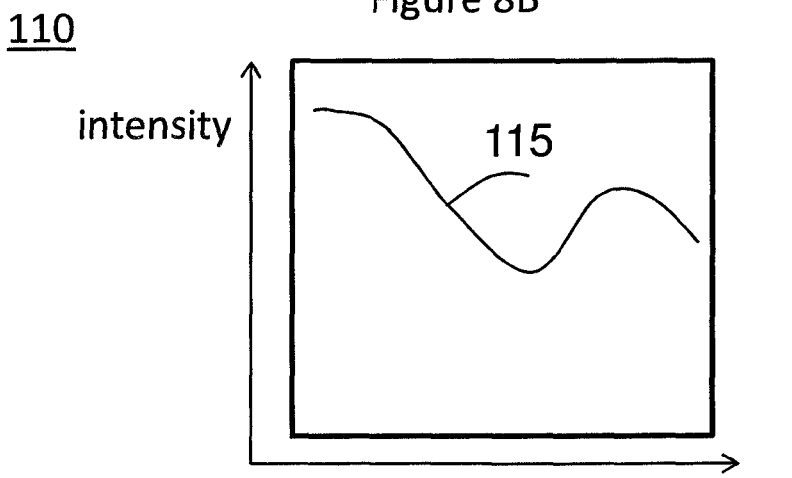

FIGS. 8A-8C illustrate the allocation of different areas on touch sensitive sensor 110 to different processing types, e.g. different effect combinations, different band filters of frequency bands and other combinations of state change characteristics.

For example, different defined areas 113 on touch sensitive sensor 110 may relate to specific sound characteristics such as effect combinations (FIG. 8A). Another example is the emulation of a graphic equalizer, in which, different defined areas, such as columns 114 (FIG. 8B), on touch sensitive sensor 110 may correspond to different band filters, and the location of the finger is used to indicate the relative intensity of each filter. The differing characteristics comprise band filters of specified frequencies and widths.

Touch sensitive sensor 110 may comprise a touchpad having an interface surface, on which different areas 113 are defined to relate to at least one of: a combination of state change characteristics, characteristics of a band pass filter applied to the electric audio signal, and characteristics of harmonies added to the electric audio signal.

Processing unit 120 may be further arranged to change a frequency response associated with electric audio signal 200 according to a curve 115 delineated by a finger on touch sensitive sensor 110 (FIG. 8C). Another example for the state change characteristics a pitch of electric audio signal 200. The sound manipulator may e.g. add a transposition of electric audio signal 200 into a higher or lower specified pitch in addition to electric audio signal 200, and the added sound may be controlled by finger movements on touch sensitive sensor 110.

A graphic equalizer comprises a bank of sliders for boosting and cutting different bands (or frequency ranges) of sound. Each band is controlled by a band filter. The area of touch sensitive sensor 110 may be separated to stripes corresponding to these bands. Finger touch may determine range and intensity of each filter. Touch sensitive sensor 110 may be arranged to allow a user indicate a continuous line thereupon, and adjust filters to achieve the indicated frequency response.

The state change characteristic may comprise relative intensities of harmonies in electric audio signal 200 and to add sounds and harmonies thereto. For example, tapping of finger positions may be used to determine relative intensities of the harmonies from which electric audio signal 200 is composed, such as to allow the player change the character and timbre of the instrument during playing.

The amplitudes of each harmonic component in electric audio signal 200 may be increased or decreased by corresponding touches on touch sensitive sensor 110, either in a preprogrammed way (e.g. adding a tone above the played tone, adding an octave harmony, adding a low harmony of half the frequency of the played tone). Areas 113 may be allocated to specific harmonic additions or substitutions (preprogrammed or defined while playing), e.g. different areas 113 for an addition of a sub-octave, an octave, two octaves etc. Columns 114 may be allocated to specific harmonic additions or substitutions and the position of the finger within column 114 may be used to determine the intensity of the corresponding sound component, e.g. a harmony or an added tone.

Figure 9A:
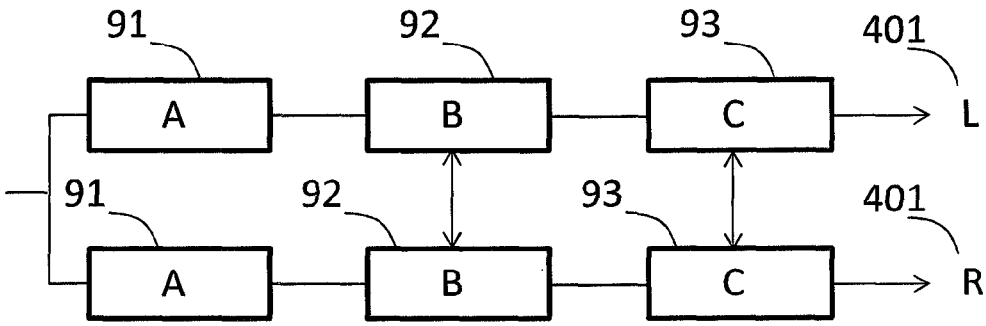
FIGS. 9A and 9B illustrate state change characteristics relating to different channels, according to some embodiments of the invention.
Figure 9B:
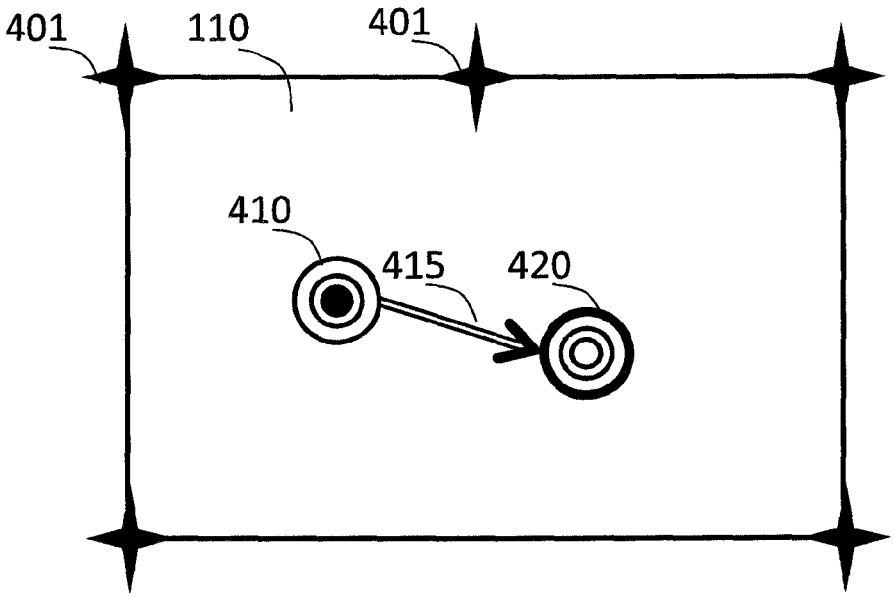

FIGS. 9A and 9B illustrate state change characteristics relating to different channels, according to some embodiments of the invention.

State change characteristics may comprise a change in balance between different channels, such as to interpret the two dimensional signal inputted through the touch sensitive sensor 110 as a spatial design of the sound. For example, finger moves may influence stereo or surround sound parameters such as balance or perceived motion of the sound. State change characteristics may comprise a relative intensity of different channels or an association of sound effects with sound channels.

As illustrated in FIG. 9A, effects 91, 92 and 93 may be associates with different outputs 401 such as left and right channels, and be switched between the outputs upon state changes, with corresponding state change characteristics.

The position of the finger may determine the relative power of different output channels, for example touching the left part of the touchpad may produce sound from the left speaker only, and moving the finger to the right end of touch sensitive sensor 110 may produce sound from the right speaker only. For example, the position of the finger relative to the borders of touch sensitive sensor 110 may be linearly interpreted as the balance between the left and right channels (e.g. on touch sensitive sensor 110 having 1024 pixels, a location of 800 pixels to the left translates to ca. 78% of the signal in the left channel, and the rest 22% in the right channel. In case of a surround sound system, the speakers may be arbitrarily mapped upon touch sensitive sensor 110 and the relative position of the finger determines the relative volume of the speakers. For example, in a 2000×2000 pixel touch sensitive sensor 110, four speakers may be mapped in the corners and a central speaker in the center of sensor 110 (1000, 1000) or in the center of one of its sides (0, 1000) as illustrated in FIG. 9B.

Single effects may also be moved from channel to channel, corresponding with finger movements on touch sensitive sensor 110. For example a distortion effect may be applied only to one channel or only to one output 401.

FIG. 9B further illustrates a case of the two states 410, 420 occurring at different positions on touch sensitive sensor 110. In some embodiments of the invention, "touch" 410 and "release" 420 may occur on different positions and the distance 415, e.g. a finger slide, may be used to encode a further state change, a state change characteristic or a combination thereof, such as for example a change in the balance between outputs 401, or any combination of effects and their parameters. The magnitude and direction of distance 415 may be used either separately or in combination to encode the respective feature.

Distance 415 between the finger contact upon the touch sensitive sensor ("touch" 410) and the finger detachment from the touch sensitive sensor ("release" 420) may be used to change a state change (e.g. switch touch and release), a state change characteristic (e.g. widen or narrow the state change, change effects switched between states, or otherwise influence the modification of the tapping signal), the tapping signal (e.g. modify the signal itself in any manner), an association of a state characteristic with a plurality of outputs (e.g. move single effects between outputs 401 as illustrated in FIG. 9A), and a balance between different outputs (a straightforward change of balance a surround system as illustrated with outputs 401 being mapped speakers as explained above).

In the above description, an embodiment is an example or implementation of the invention. The various appearances of "one embodiment", "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Furthermore, it is to be understood that the invention can be carried out or practiced in various ways and that the invention can be implemented in embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A sound manipulator comprising:

a touch sensitive sensor arranged to detect finger tapping that comprises finger contact upon the touch sensitive sensor ("touch") and finger detachment from the touch sensitive sensor ("release"), and to generate a corresponding time-dependent tapping signal comprising a first state corresponding to periods in which the finger contacts the touch sensitive sensor and a second state corresponding to periods in which the finger does not contact the touch sensitive sensor; and a processing unit arranged to:

receive an electric audio signal associated with an instrument that is played during the finger tapping;

receive at least one state change characteristic;

modify the time-dependent signal corresponding to the finger tapping according to the at least one state change characteristic; and multiply, with a common time base, the modified time-dependent signal with the electric audio signal, to yield a modified electronic signal, wherein changes of the modified electronic signal during changes between the first and the second states of the tapping signal are characterized by the at least one state change characteristic.

2. The sound manipulator of claim 1, wherein the modified electronic signal substantially equals the electric audio signal during substantially the duration of one of: the first, and the second state, and wherein the modified electronic signal comprises substantially a low volume version of the electric audio signal, characterized by the at least one state change characteristic during substantially the duration of the other one of: the second, and the first state, respectively.

3. The sound manipulator of claim 1, wherein the electric audio signal comprises at least one of: a basic signal; and at least one sound effect, and wherein the processing unit is arrange to multiply, with a common time base, the modified time-dependent signal with the at least one of: a basic signal; and at least one sound effect to yield the modified electronic signal.

4. The sound manipulator of claim 3, wherein the multiplying of the modified time-dependent signal with the electric audio signal comprises differing specified sound effect compositions for the first and the second state.

5. The sound manipulator of claim 1, wherein the touch sensitive sensor is further arranged to detect finger positions upon the touch sensitive sensor and to generate the corresponding time-dependent tapping signal in relation to the detected finger positions according to specified rules, to yield differing time-dependent tapping signals for different finger positions.

6. The sound manipulator of claim 5, wherein the received at least one state change characteristic comprise differing characteristics associated with differing finger positions on the touch sensitive sensor, such that tapping at different positions on the touch sensitive sensor yield different types of modifications of the modified electronic signal.

7. The sound manipulator of claim 6, wherein the differing characteristics comprise band filters of specified frequencies and widths.

8. The sound manipulator of claim 1, wherein the processing unit is further arranged to change a frequency response associated with the electric audio signal according to a curve delineated by a finger on the touch sensitive sensor.

9. The sound manipulator of claim 1, wherein the touch sensitive sensor is further arranged to detect finger pressure on the touch sensitive sensor, and wherein the processing unit is arranged to adapt the received at least one state change characteristic according to the detected finger pressure.

10. The sound manipulator of claim 1, wherein the at least one state change characteristic comprises at least one of: an association of "touch" and "release" with the first and the second states; an attenuation state associated with at least one of the states; and types of transitions in the modified electronic signal upon changes of the tapping signal between states.

11. The sound manipulator of claim 1, wherein the electric audio signal is received from an amplified guitar, wherein the touch sensitive sensor is positioned on the amplified guitar, wherein the modified electronic signal comprises modifications that comprise at least one of: at least a partial muting of the electric audio signal; at least a partial muting of sound effects incorporated in the electric audio signal; a transformation in frequency space of the electric audio signal and changes of sound effect characteristics, and wherein the modifications are determined by a player of the amplified guitar both by defining the at least one state change characteristic and by a connection position of the touch sensitive sensor within an assembly of sound effects connected to the amplified guitar.

12. The sound manipulator of claim 11, wherein the electric audio signal is sustained before entering the touch sensitive sensor, to yield a percussion-like effect on fretted notes, thereby allowing the player to pick and/or tap the fretted notes.

13. An amplified guitar comprising the sound manipulator of claim 11.

14. The sound manipulator of claim 1, wherein the at least one state change characteristic comprises a pitch of the electric audio signal.

15. The sound manipulator of claim 1, wherein the at least one state change characteristic comprises a relative intensity of different channels.

16. The sound manipulator of claim 1, wherein the at least one state change characteristic comprises an association of effects with sound channels.

17. The sound manipulator of claim 1, wherein the at least one state change characteristic comprises relative intensities of harmonies in the electric audio signal.

18. The sound manipulator of claim 1, further comprising a quantization module arranged to fit the time-dependent tapping signal onto a specified temporal grid, such as to allow synchronization of the modified electronic signal with other electronic signals having their temporal grids.

19. The sound manipulator of claim 1, further comprising a recorder arranged to record the time-dependent tapping signal, and wherein the processing unit is arranged to generate the modified electronic signal from the recorded played time-dependent tapping signal and the electric audio signal upon a specified finger tap detected by the touch sensitive sensor.

20. The sound manipulator of claim 1, wherein the touch sensitive sensor is further arranged to detect finger movement upon the touch sensitive sensor, and wherein the processing unit is arranged to adapt the modification according to the detected finger movement.

21. The sound manipulator of claim 1, further comprising a communication module arranged to allow at least one of: transmit the signals from the touch sensitive sensor to the processing unit; transmit the electric audio signal to the processing unit; and transmit the modified electronic signal from the processing unit to a control unit.

22. The sound manipulator of claim 1, wherein the touch sensitive sensor is a touchpad having an interface surface, on which different areas are defined to relate to at least one of: a combination of state change characteristics, characteristics of a band pass filter applied to the electric audio signal, and characteristics of harmonies added to the electric audio signal.

23. The sound manipulator of claim 1, wherein a distance between the finger contact upon the touch sensitive sensor ("touch") and the finger detachment from the touch sensitive sensor ("release") is used to change at least one of: a state change, a state change characteristic, the tapping signal, an association of a state characteristic with a plurality of outputs, and a balance between different outputs.

24. A method comprising:

generating, from detected finger tapping on a surface, a corresponding time-dependent tapping signal comprising a first state corresponding to periods in which the finger contacts the surface and a second state corresponding to periods in which the finger does not contact the surface; and multiplying, with a common time base, the time-dependent signal with an electric audio signal associated with an instrument that is played during the finger tapping, to yield a modified electronic signal, wherein changes of the modified electronic signal during changes between the first and the second states of the tapping signal are characterized by at least one specified state change characteristic.

25. The method of claim 24, further comprising defining the at least one specified state change characteristic comprises at least one of: an association of finger contact with the surface and finger detachment from the surface with the first and the second states; an attenuation state associated with at least one of the states; and types of transitions in the modified electronic signal upon changes of the tapping signal between states.

26. The method of claim 24, wherein the modified electronic signal comprises modifications that comprise at least one of: at least a partial muting of the electric audio signal; at least a partial muting of sound effects incorporated in the electric audio signal; and changes of sound effect characteristics.

27. The method of claim 24, further comprising generating a guitar sound by fretting the strings and simultaneously tapping with at least one finger upon the surface to modify the simultaneous guitar produced electronic signal.

28. The method of claim 24, further comprising recording a pattern of finger actions and applying the modifications relating to the pattern repeatedly.

* * * * *